US009599444B2

(12) United States Patent
Rachlin

(10) Patent No.: US 9,599,444 B2
(45) Date of Patent: Mar. 21, 2017

(54) ACCELERATOR

(71) Applicant: Felix Rachlin, Herzliya (IL)

(72) Inventor: Felix Rachlin, Herzliya (IL)

( * ) Notice: Subject to any disclaimer, the term of this patent is extended or adjusted under 35 U.S.C. 154(b) by 0 days.

(21) Appl. No.: 14/768,921

(22) PCT Filed: Jun. 15, 2014

(86) PCT No.: PCT/IL2014/050539

§ 371 (c)(1),
(2) Date: Aug. 19, 2015

(87) PCT Pub. No.: WO2015/068151

PCT Pub. Date: May 14, 2015

(65) Prior Publication Data

US 2016/0238361 A1 Aug. 18, 2016

(30) Foreign Application Priority Data

Nov. 7, 2013 (IL) ..... 229290

(51) Int. Cl.

| | |
|---|---|
| ***F42B 30/02*** | (2006.01) |
| ***F42B 10/38*** | (2006.01) |
| ***F42B 5/02*** | (2006.01) |
| ***F42B 5/03*** | (2006.01) |
| ***F42B 5/045*** | (2006.01) |
| ***F41A 1/02*** | (2006.01) |
| ***F42B 15/10*** | (2006.01) |

(52) U.S. Cl.

CPC ..... *F42B 30/02* (2013.01); *F41A 1/02* (2013.01); *F42B 5/02* (2013.01); *F42B 5/03* (2013.01); *F42B 5/045* (2013.01); *F42B 10/38* (2013.01); *F42B 15/10* (2013.01)

(58) Field of Classification Search

CPC .... F42B 4/02; F42B 5/045; F42B 5/10; F42B 5/105; F42B 5/184; F42B 10/32; F42B 10/34; F42B 10/38; F42B 10/42; F42B 10/44; F42B 14/06; F42B 14/08; F42B 30/02; F42B 5/02; F42B 5/03; F42B 15/10; F41A 1/02

USPC ..... 102/346, 360, 376, 433, 434, 439, 503, 102/508, 509, 517, 520, 532

See application file for complete search history.

(56) References Cited

U.S. PATENT DOCUMENTS 15,999 A * 10/1856 Read ..... F42B 14/02 102/526
33,099 A * 8/1861 Parrott ..... F42B 14/02 102/526

(Continued)

FOREIGN PATENT DOCUMENTS

CH 101017076 A 8/2007

OTHER PUBLICATIONS

Smart Bullets Sandia National Laboratories Aug. 24, 2010.

*Primary Examiner* — Bret Hayes
(74) *Attorney, Agent, or Firm* — Nadya Reingand; Yan Hankin

(57) ABSTRACT

A multi-part projectile accelerator to be used in the single or multiple projectile mode, constructed of the hollow and tubular body which may either self-disconnect, once the projectile leaves the barrel, or stay with the projectile for the duration of the flight; which may also include the ring member designed to fit into the grooves of the rifled barrel in order to assist in maintaining the rotation of an accelerator.

7 Claims, 3 Drawing Sheets

(56) References Cited

U.S. PATENT DOCUMENTS 39,112 A * 7/1863 Berney ..... F42B 14/02 102/526
2,507,878 A * 5/1950 Banning, Jr. ..... F41A 1/00 102/517
3,024,729 A * 3/1962 Kluge ..... F42B 5/10 102/503
3,065,696 A * 11/1962 Kleinguenther ..... F42B 10/26 102/517
3,229,583 A * 1/1966 Long ..... F41A 21/16 102/517
3,601,056 A * 8/1971 Nicholson ..... F42B 15/00 102/376
3,713,388 A * 1/1973 Pontoriero ..... F42B 7/08 102/436
3,903,802 A 9/1975 Squiers
3,939,773 A * 2/1976 Jenkins ..... F42B 10/04 102/526
4,063,486 A * 12/1977 Ashley ..... F41A 1/04 102/440
4,730,561 A * 3/1988 Schaake ..... F42B 10/06 102/517
4,736,686 A * 4/1988 Martin ..... F42B 12/08 102/351
5,173,571 A * 12/1992 Montgomery ..... F42B 5/045 102/434
5,297,492 A * 3/1994 Buc ..... F42B 14/061 102/513
5,325,785 A * 7/1994 Gardner ..... F42C 19/0834 102/430
5,616,884 A * 4/1997 Solberg ..... C06B 45/12 102/284
6,655,293 B1 * 12/2003 Henry ..... F42B 12/38 102/439
6,796,068 B2 * 9/2004 Crowson ..... F42B 14/00 102/520
7,781,709 B1 8/2010 Jones et al.
2010/0269725 A1 * 10/2010 Hall ..... F42B 14/06 102/520
2011/0214582 A1 * 9/2011 Glasser ..... F42B 12/44 102/439
2012/0152144 A1 6/2012 AlSalem
2012/0199034 A1 * 8/2012 Gibson ..... F42B 12/40 102/502

* cited by examiner

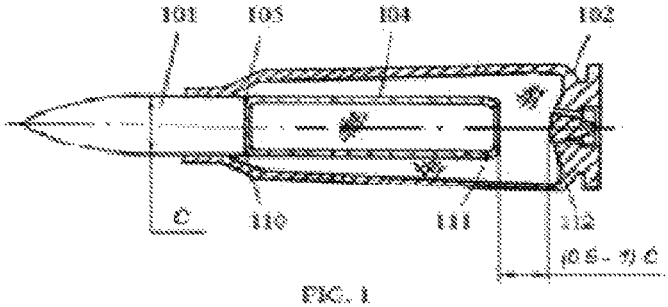
FIG. 1
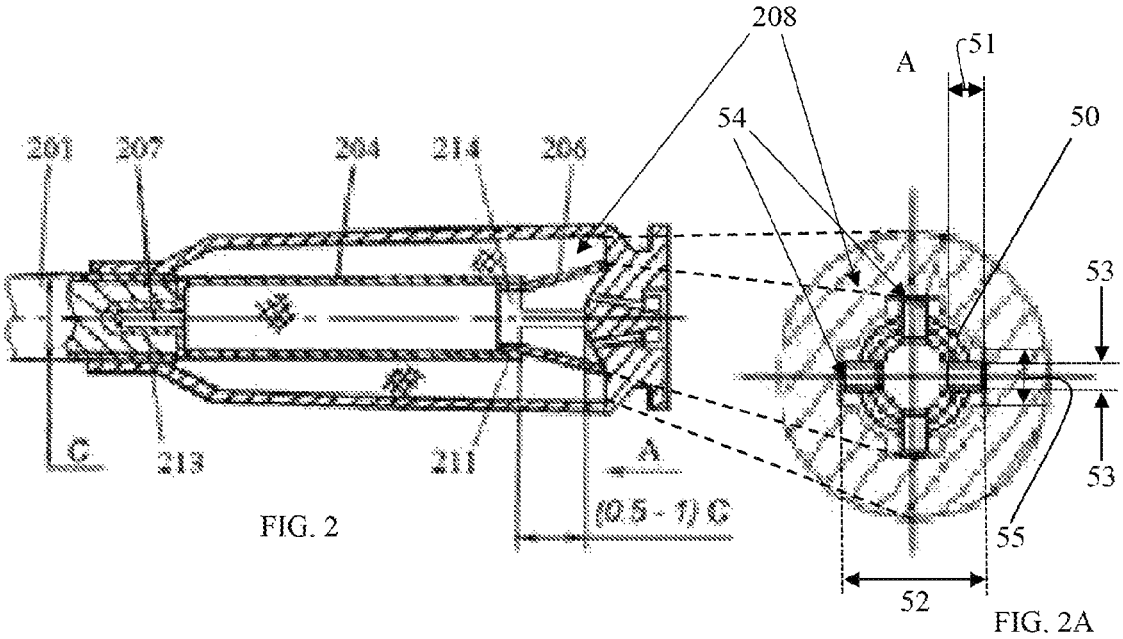
FIG. 2
FIG. 2A
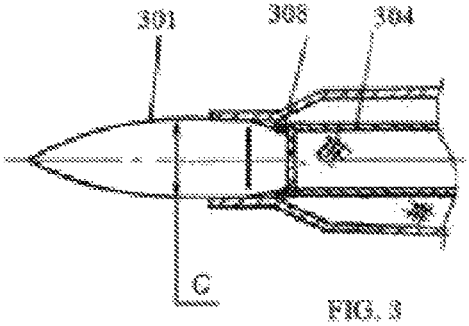
FIG. 3

The curves of pressure, velocity and time of the bullet motion in the rifle bore model 1901/30

ACCELERATOR

CROSS-REFERENCE TO RELATED APPLICATIONS

Current patent application is a National stage application from PCT application No. PCT/IL2014/050539 filed on Jun. 15, 2014 which claims priority to Israeli patent application IL229290 filed on Nov. 7, 2013.

TECHNICAL FIELD

The present invention pertains to area of armament, including barreled weapons, rifled weapons, smooth-bore weapons, artillery systems and ammunition.

DESCRIPTION OF THE RELATED ART

From analyzing the development of barreled firearms and artillery it is evident that the development of metallurgy, chemistry, optics and electronics allows to create a reliable, rapid-firing and highly-precise weapon systems and ammunition. Guided and smart munition, and projectiles are known in the art as well. Despite the ongoing technical progress in weapon design, there is no improvement that would be responsible for the increase of muzzle energy of a projectile.

Russian patent RU2372581 describes a cartridge with as jet-bullet. In this patent, the bullet has a complicated structure and due to its thin walled cavity it is unable to withstand high pressure needed to achieve high velocity.

Russian patent RU2151371 describes a bullet with as cavity. The bullet is supposed to be further accelerated by the escaping gases from its cavity.

Russian patent RU2150074 describes a bullet with a propellant charge. However due to the low power of the propellant charge, the gain of speed is minimal.

Other relevant armaments are M198 duplex cartridge and multiple projectile cartridge described in Russian patent RU2438093.

Other relevant publications are: Patents: RU2107886, RU2372251, RU2206052, RU2151371, RU2453801, RU2287769, RU2099667, RU2150074, RU2075033, RU2100769, RU2438093; and books: I. Strezhnev. Artillery pieces with segmented kinetics (1944-48), Serebryakov M. Internal ballistics of barreled systems and solid fuel rockets. Moscow Oborongiz 1962; Gorokhov M. Internal ballistics of barreled systems. Moscow 1985; Kirillov V., Sabelnikov V. Firearm ammunition. Moscow 1980. Malov A. Manufacture of firearm ammunition. Moscow Oborongiz 1947; Menshikov N. Album of designs of large caliber firearms for automatic weapons. Moscow 1947; Murahovskiy V., Fedoseev S. infantry weapons. Moscow, Arsenal-Press 1992; Safaryants A. Cartridge and casing production technology. Training manual for colleges 1975; Basics of the device and the design of guns and ammunition of land based artillery. Moscow Military Publishing House of the USSR Ministry of Defense 1976.

SUMMARY OF THE INVENTION

In accordance with one aspect of the invention, a projectile accelerator is provided. The accelerator comprises a tubular body with one sealed end and a nozzle at the opposite end thereof. The accelerator is attached by the sealed end (either permanently or non-permanently) to a projectile.

The accelerator may have a form of a hollow bullet and may be utilized in a single or a multiple projectile cartridge.

In accordance with another aspect of the invention, a method for creating a barreled weapon is disclosed. The weapon has a barrel length that increases or maximizes the energy stored in the accelerator,

BRIEF DESCRIPTION OF THE DRAWINGS

Exemplary embodiments of the present invention will now be described, by way of example only, with reference to the accompanying drawings, in which:

FIG. 1 is a side cut-off view of an embodiment of an accelerator inside a cartridge;

FIG. 2 is a side cut-off view of an embodiment of a detachable accelerator inside a cartridge;

FIG. 3 is a side cut-off view of another embodiment of a detachable accelerator inside a cartridge;

DETAILED DESCRIPTION

Figure 4:
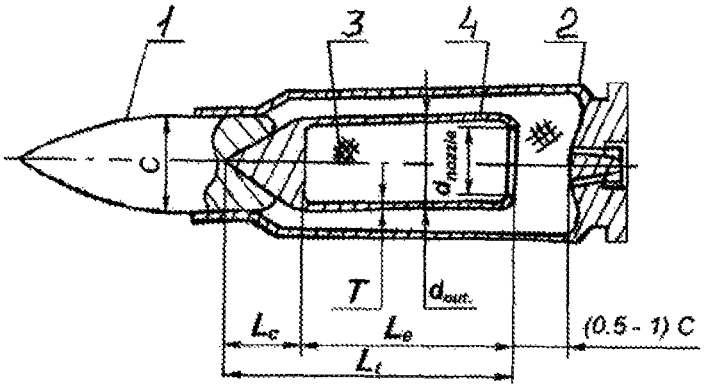
FIG. 4 is a side cut-off view of an embodiment of a bullet shaped accelerator inside a cartridge.

The present invention comprises an improvement in projectile design and is intended to increase the muzzle energy of a projectile. The increase in muzzle energy of a projectile is achieved by including an additional component, an accelerator, in the projectile structure. Usually, a projectile (for example, a bullet) is projected in two steps. In the first step, the projectile is accelerated, in the barrel, and in the second step, the projectile continues with its motion due to the inertia. Due to the accelerator, an additional step may be included in the projection process. This step provides an additional acceleration, caused by the accelerator. The additional acceleration begins immediately once the projectile leaves the barrel. The accelerator allows to significantly increase, by order of magnitude, a muzzle velocity and the muzzle energy of the projectile.

Due to the high temperature (up to 2500° C.), that affects the accelerator during the acceleration, and high pressure (more than 350 MPa), that affects the accelerator during the additional acceleration, it is advisable to manufacture said accelerator from a heat resistant, light and strong material such as a high strength steel.

In one embodiment, as depicted in FIG. 1, an accelerator 104 is designed to have a tubular form with an outer diameter smaller by 1% to 5% than a projectile caliber (C). The accelerator 104 has a sealed end no and a nozzle 111 located at the opposite end thereof. The accelerator 104 is located inside a case 102, and there is a gap between the nozzle 111 and a case base 112 ranging from a half to a full caliber length. The accelerator 104 is coaxially connected, by its sealed end 110, to a bottom surface 105 of the projectile 101, wherein said connection is either a permanent connection or a non-permanent connection.

In a case of a non-permanent or detachable connection of an accelerator to a projectile, the accelerator is removed from the projectile by an incoming stream of air, after the projectile leaves a barrel.

In another embodiment, as depicted on FIG. 2 and FIG. 2A, an accelerator 204 is detachably connected, by a pin 207, to a hole 213 in a projectile 201. The hole 213 is located on the bottom surface of the projectile 201. A nozzle 211 of the accelerator 204 contains a ring member 214 with legs 206 that help in maintaining an axial position of the nozzle 211. The legs 206 are adapted to fit inside the grooves 54 of a rifle barrel 208 and thus assist in maintaining the rotation of the accelerator 204 and the projectile 201 during their movement thought the barrel 208. The legs have (1) a separation (i.e. space) 50, between each leg 206, (2) a thickness 51, and (3) a width 53. The grooves 54 have (1) a groove length 52 and (2) a groove width 55.

In yet another embodiment, as depicted in FIG. 3, an accelerator 304 is detachably connected by a concentric ring 308 to a tapered end of a projectile 301.

In yet another embodiment, as depicted in FIG. 4, an accelerator 404 has a form of a hollow bullet and it can be used with single projectile ammunition.

Figure 5:
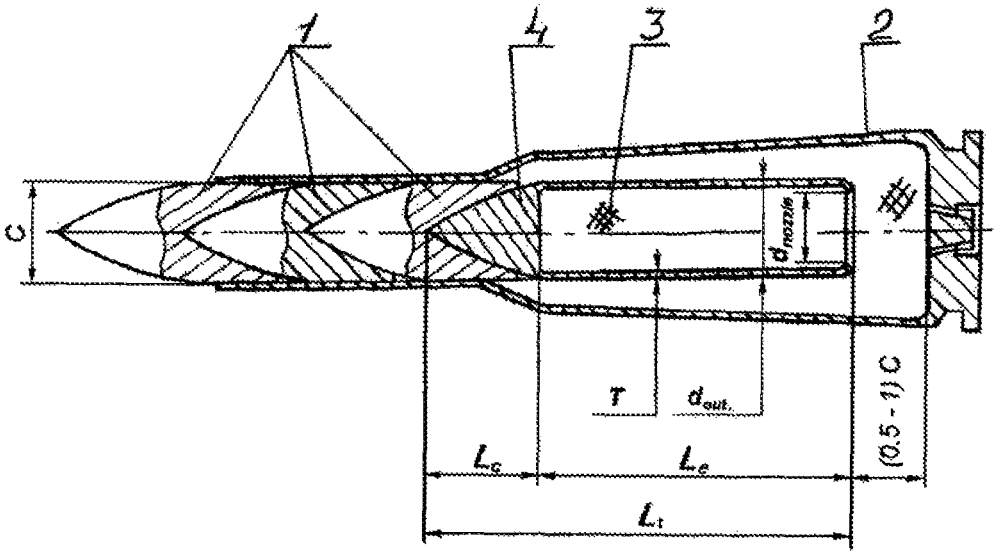
FIG. 5 is a side cut-off view of an embodiment of a bullet shaped accelerator inside a multiple projectile cartridge.

In yet another embodiment, as depicted in FIG. 5, an accelerator 504 has a form of a hollow bullet and it can be used with multiple projectile ammunition.

Figure 6:
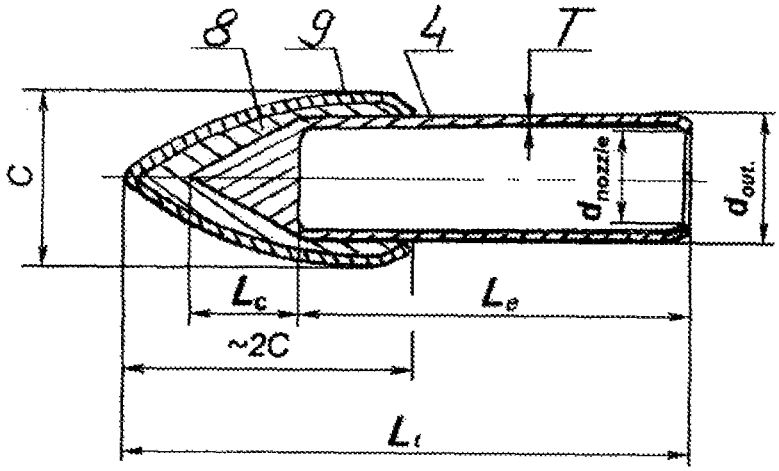
FIG. 6 is a side cut-off view of an embodiment of a bullet shaped accelerator having a jacketed lead head.

In yet another embodiment, as depicted in FIG. 6, an accelerator 604 includes a jacketed lead head 609.

Due to the additional thrust, caused by the accelerator, the projectile gains an additional speed. This gain in speed is a function of the pressure inside the accelerator and its operation time. The operation time of an accelerator is a function of its volume and the gas speed at the nozzle. The accelerator's volume is devised from the inner dimensions of the cartridge. The gas speed at the nozzle depends on physical characteristics and temperature of the propellant gas.

Figure 7:
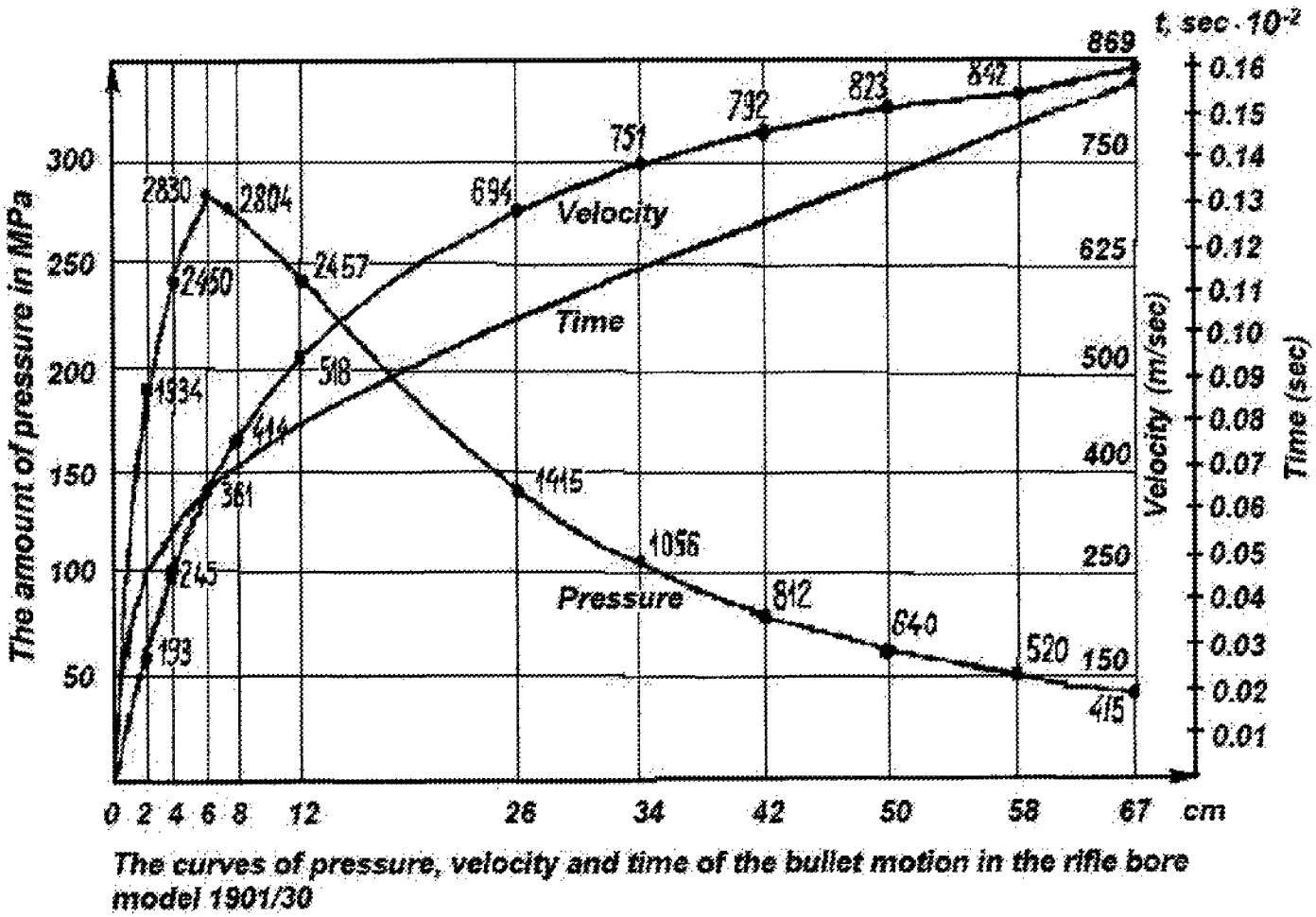
FIG. 7 is a graph showing curves of pressure, velocity and time of the bullet motion in a rifle bore.

The pressure inside the barrel (and thus the pressure inside the accelerator) could be controlled by utilizing high pressure gases present in the barrel, as shown in the pressure vs. barrel length graph depicted in FIG. 7. As shown in the graph, the pressure in the barrel increases with a decrease in length of the barrel.

Decreasing the length of the barrel causes an increase in the gas energy stored in the accelerator, and thus a higher speed and energy during the additional acceleration phase.

For example, if the barrel of a Mosin rifle is shortened to 100 mm, the pressure at that point may be 250 MPa and the bullet speed may be increased by factor of two or three and the muzzle energy may be increased anywhere from 400% to 900%.

An increase in muzzle energy would cause an increase in a: velocity of a projectile, stopping power of a projectile, a penetration depth, an effective range, fire power (for multiple projectile ammunition), projectile weight.

A decrease in band length would reduce the weight of a weapon, its size, the cost of production and make the manufacturing process less complicated.

There are several options for using accelerator based ammunition:

Using an accelerator with current and unmodified weaponry. In this case the muzzle energy might be increased by 13% to 94%.

Using an accelerator with a modified weaponry. The weapon is modified by:

a. shortening the barrel (and thus increasing the barrel pressure according to a pressure vs. barrel length graph), the muzzle energy could be increased, by 305% to 783%;
b. boring the barrel till the desired barrel pressure is reached (according to a pressure vs. barrel length graph). The boring also increases the barrel caliber by 5% to 15%. The muzzle energy in this case could be increased by 305% to 783% as well.

Another option is to design a new barrel, adapted for firing an accelerator based ammunition.

The greatest increase in muzzle energy could be achieved when the weaponry and the ammunition are specifically designed for use with an accelerator.

The invention claimed is:

1. An accelerator, comprising:
a body and a ring member,
the body having a sealed end and an unsealed end located opposite the sealed end,
wherein the unsealed end is a nozzle, and wherein the accelerator is coaxially connected to a projectile at the sealed end,
wherein the body has an outer diameter 1% to 5% smaller than that of the projectile,
wherein said ring member s connected to the body and is comprised of legs, the legs expanding outward at distal portions thereof,
wherein the ring member extends past the body in a longitudinal direction of the accelerator defining outermost ends of the accelerator,
each of said legs having a width and a thickness, and said legs being spaced from one another, such that said widths, said thicknesses, and said spacing of said legs match grooves located in a barrel of a weapon,
said accelerator having a tubular shape and a hollow construction.

2. The accelerator of claim 1, wherein the accelerator is constructed to be inseparable from the projectile after firing by centrifugal force and air drag.

3. The accelerator of claim 1, wherein the accelerator is constructed to be separated from the projectile after firing by centrifugal force and air drag.

4. The accelerator of claim 3, wherein the accelerator further comprises a jacketed lead head.

5. The accelerator of claim 1, wherein a connection between the accelerator and the projectile is a pin hole mating connection.

6. The accelerator of claim 1, wherein a connection between the accelerator and the projectile includes a concentric ring that connects the accelerator to a tapered end of the projectile.

7. The accelerator of claim 1, wherein said barrel is shorter than a standard barrel length for said weapon.

* * * * *